United States Patent [19]

Calvin et al.

[11] Patent Number: 4,502,851

[45] Date of Patent: Mar. 5, 1985

[54] PIVOTAL DISCHARGE APPARATUS

[76] Inventors: Vaughn Calvin; Raymond J. Cox, both of P.O. Box 3908, Bryan, Tex. 077805

[21] Appl. No.: 441,269

[22] Filed: Nov. 12, 1982

[51] Int. Cl.[3] ..... F04B 15/02

[52] U.S. Cl. ..... 417/516; 417/519; 417/532; 417/900

[58] Field of Search ..... 417/516, 517, 900, 519, 417/532, 365

[56] References Cited

U.S. PATENT DOCUMENTS

| | | | |
|---|---|---|---|
| 3,832,097 | 8/1974 | Schlect | 417/516 |
| 3,947,153 | 3/1976 | Matthias et al. | 417/365 |
| 4,178,142 | 12/1979 | Schwing | 417/900 |

FOREIGN PATENT DOCUMENTS

| | | | |
|---|---|---|---|
| 2841514 | 4/1980 | Fed. Rep. of Germany | 417/900 |
| 2909312 | 9/1980 | Fed. Rep. of Germany | 417/900 |
| 2931814 | 2/1981 | Fed. Rep. of Germany | 417/900 |

*Primary Examiner*—Carlton R. Croyle
*Assistant Examiner*—Peter M. Cuomo

[57] ABSTRACT

An apparatus for oscillating a distribution duct between two outlets of adjacent pump cylinders and a common discharge pipe. A portion of the apparatus pivots with the discharge pipe and cooperates with a stationary housing to relieve thrust loads imparted during the pumping operation. A movable hopper is employed to feed material to the pumps and facilitate access to internal portions of the hopper for cleaning.

26 Claims, 6 Drawing Figures

PIVOTAL DISCHARGE APPARATUS

BACKGROUND AND DISCUSSION OF THE INVENTION

A number of systems have been employed to control the material flow from alternating piston pumps while pumping semiliquid or plasticized material containing aggregate chips, waste solids, concrete, etc., and channeling the discharge from the two pump cylinders into one discharge line. Generally this has been accomplished by employing a swiveling discharge pipe so that the inlet of the delivery pipe is connected to the outlet end of the discharge pipe during the appropriate phase on one of the pump cylinders. In other words, a connecting pipe is communicated alternately with the pump during the drive stroke of the pump for delivering the material from the pump to the discharge valves.

In arriving at an apparatus for accomplishing this oscillating movement of the connecting pipe, a number of problems have been incurred that have been characteristic of the apparatus used thus far. Often the apparatus is rather large and cumbersome requiring relatively substantial space for its operation. In addition, a thrust load imposed on the duct work during the power stroke of the piston has not been adequately compensated. Where compensation has been made to counteract these thrust forces additional structure exterior to the pipe apparatus has been required, adding to the need for even more space for the apparatus to operate properly. Due to the change in direction required by the connecting duct moment or torque forces are also created which produce undue wear on various parts of the apparatus if not compensated properly. The above has been a summary of some of the problems which have characterized apparatus and oscillating duct type pivotal discharge valves employed heretofore. Many of these problems as well as others have been overcome by the invention described herein.

The pivotal discharge apparatus of the invention described herein provides an economic and effective system to pump and channel discharge materials from two pump cylinders into the one line, substantially reducing, and in some cases eliminating, the problems noted above. The pivotal discharge valve of the invention employs a center pivot and thrust tube having a thrust plate extending radially therefrom supported for pivotal movement within a stationary housing. A pivotal arm attached to the pivot and thrust tube is actuated to oscillate a distribution duct between the two pump cylinders. Since the distribution duct makes about 180° bend between the discharge pipe and the material pump, forces are imparted to certain parts of the apparatus. The thrust plate on the center of the pivot and thrust tube controls these forces in a plane perpendicular to the center axis of the pivot tube and relieves pivot support bushings of sustaining the full load of this plane. In addition, counterforce rollers may be placed at the top of the pivotal arm to counteract extreme forces experienced at the bottom of the pivotal arm during the power stroke in the material pump cylinders. Other apparatus such as wear plates, adjustment mechanisms, actuating mechanisms, etc., are discussed in detail in preferred embodiment which follows hereinafter. These features as well as more detailed features which will be discussed later herein overcome the problems which have been noted above and provide a compact, efficient apparatus for controlling the discharge in a multiple pump system.

DETAILED DESCRIPTION OF THE PREFERRED EMBODIMENT

Figure 1:
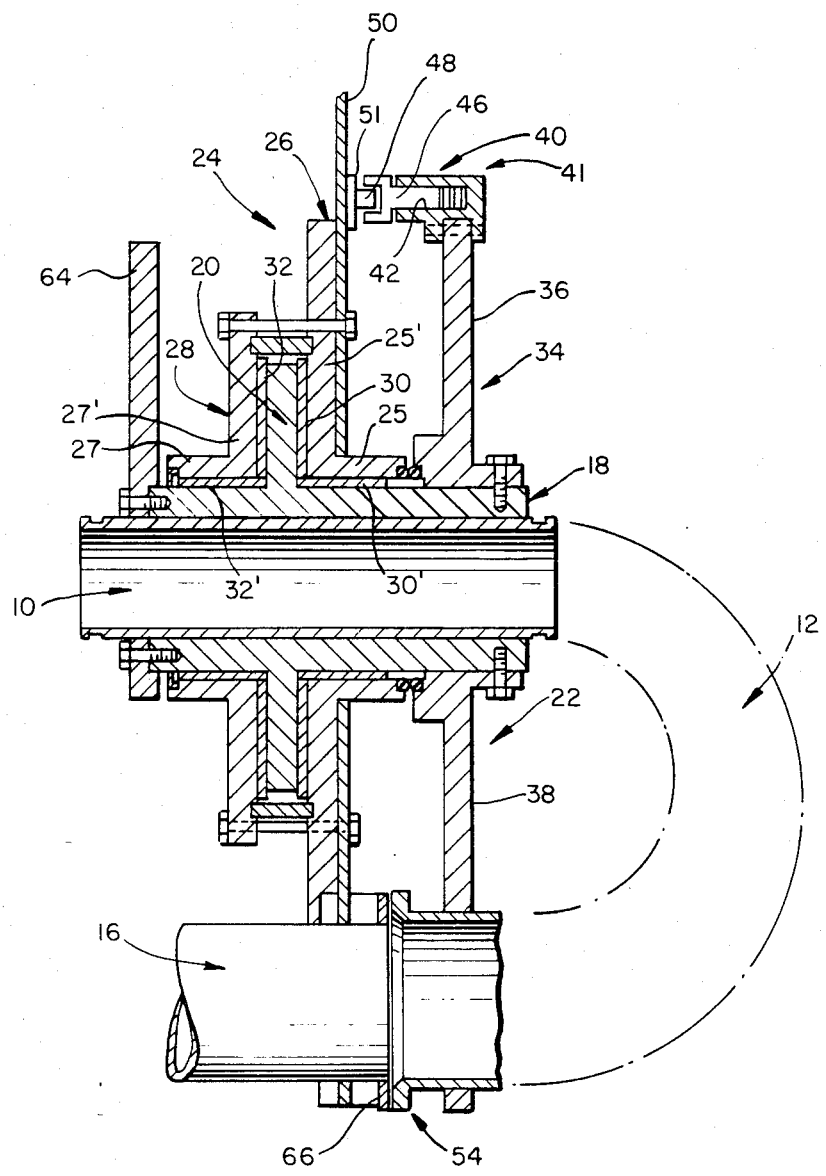
FIG. 1 is a cross section view of the pivotal discharge apparatus.

As can be seen in FIG. 1, the apparatus includes a material discharge pipe 10. Radially displaced from discharge pipe 10 is a material pump cylinder 16 having an outlet 17 which dispenses material ultimately to the inlet of discharge pipe 10. Although it is not shown, it should be understood that two of these material pump cylinders are arranged adjacent to one another and each has a piston which operates out of phase with the adjacent piston. During the power stroke material is discharged through one material pump cylinder outlet while the adjacent cylinder simultaneously draws materials into the outlet for a subsequent power stroke. A distribution duct 12 is arranged for pivotal movement with respect to the housing 24 to move the duct alternately between the outlets of the material pump cylinders 16 to communicate with the cylinder at the beginning of a power stroke. In this manner, during each power stroke, material is forced through the distribution duct which makes about 180° bend between the outlet of the material pump cylinder and the inlet to the discharge pipe 10.

A pivot and thrust tube 18 (hereinafter pivot tube 18) completely circumscribes the pipe 10 for the pivotal or rotational movement therewith. An annular plate 20 extends radially from the pivot tube 18 and moves within a housing 24. Adjacent to the inlet of discharge pipe 10 there is secured to pivot tube 18 a pivotal arm assembly 22 extending radially therefrom. Assembly 22 has a first portion 38 attached to distribution duct 12 for moving duct 12 between the outlets of two material pump cylinders 16 and may have a second portion 36 displaced from said first portion 38 for supporting a counterthrust roller assembly 40 (used for extreme pumping situations only). This assembly 40 provides a means to counteract forces imparted on assembly 22 during the power stroke of a piston within its respective material pump cylinder. As will be explained in more detail later, the counterthrust roller assembly 40 interacts with a portion 50 of fixed housing 24 to counteract the torque and other forces imposed on assembly 22.

Housing 24 is employed in conjunction with pivot tube 18 and other elements of the apparatus to define the path of rotational movement and offset certain forces imposed during the valve operation. Housing 24 includes a front pivot housing 26 and rear pivot housing 28, both completely circumscribing the pivot tube 18. Front pivot housing 26 includes a bearing portion 25, enveloping tube 18, and radial plate 25'. The latter plate defines an annular, planar surface coextensive with that of the thrust plate 20 of pivot tube 18. Similarly, rear pivot housing 28 is spaced from the front pivot housing 26 and has a bearing portion 27, enveloping tube 18, and a radial plate 27'. The latter plate 27' defines an annular, planar surface coextensive with the thrust plate 20.

A wear plate assembly is provided between the housing 24 and pivot tube 18. This wear plate assembly includes bushing members which interface the housing elements and rotative elements of the apparatus. Specifically, this includes front thrust wear plate 30 located between front pivot housing 26 and the opposed surface of thrust plate 20, and a rear thrust wear plate 32 located between rear pivot housing 28 and the opposed surface of thrust plate 20. Corresponding cylindrical portions interface between bearing portions 25 and 27 and the tube 18. Specifically, front pivot support bushing 30' is provided between bearing portion 25 and pivot tube 18 while rear pivot support bushing 32' is provided between bearing portion 27 and tube 18. In this manner bushings 30' and 32' provide a bearing surface between the pivot tube 18 and the housing 24. This assembly facilitates movement of the rotative parts with respect to the housing while simultaneously providing a bearing surface in planes parallel with and perpendicular to the inlets of the discharge pipe 12.

Figure 2:
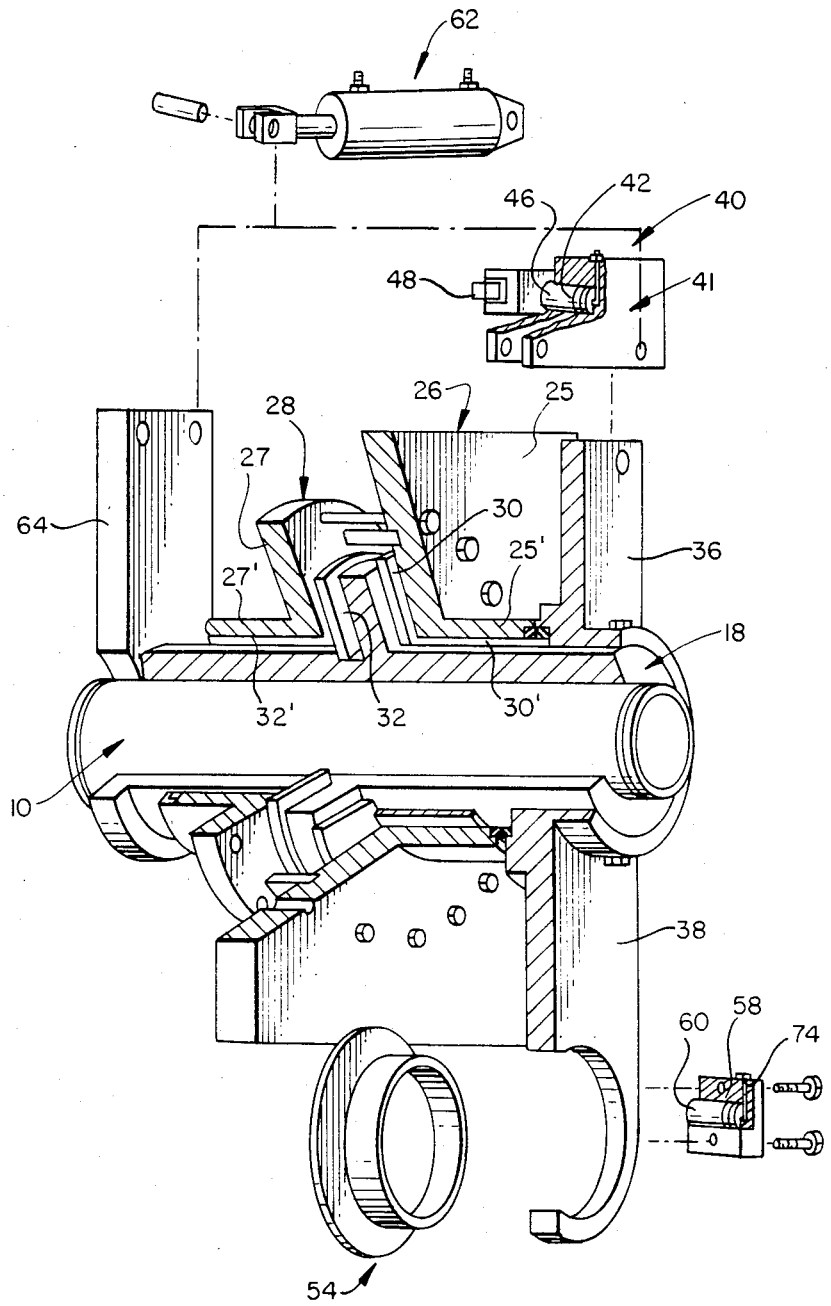
FIG. 2 is a perspective view of the pivotal discharge apparatus with a portion cut away for exposing internal parts of the apparatus.

As shown in FIGS. 1 and 2 the two elements comprising the housing, rear pivot housing 28 and front pivot housing 26, are held together in bearing engagement with the other elements of the apparatus by bolts threaded to the two opposed portions of housing 24. Secured to front pivot housing 26 is a rigid plate 50 having a bearing surface 51 thereon. Arranged for engaging bearing surface 51 is a counterthrust roller assembly 40. In this manner torque and other forces imposed on the bottom portion of pivotal arm assembly 34 are offset by the engagement of counterthrust roller assembly 40 with the rigid structure 50.

As a certain amount of wear is anticipated during the operation of such valve assembly, means are provided to compensate for the wear, insuring that the assembly works properly and offsetting the various thrust forces imposed during the pumping action of material in the pump cylinder. For example, the counterthrust roller assembly 40 includes a piston-cylinder arrangement 41. Piston 46 at one end carries roller 48 for engaging the rigid structure 50 and at the other end moves in sealing relationship with the internal walls of cylinder 42. Pressure may be applied either hydraulically or mechanically on piston 46.

At the distribution duct inlet there is a provision for accommodating wear. Material pump cylinders 16 define outlets in wear plate 66. The inlet of distribution duct bears against plate 66 during its oscillatory movement between the outlets of pump cylinders 16 during pump operation. As a result there is often wear on the plate substantial enough to change the relative position of the wear plate with respect to the inlet of the oscillating duct. This change is accommodated by making the inlet to the duct adjustable relative to the remaining portions of the duct and the pivotal arm assembly 34.

Specifically, movable wear plate 54 is provided in the inlet of duct 12 for movement relative thereto. Plate 54 has a front face for bearing against the wear plate 66. A second piston-cylinder arrangement 52, as can be seen in FIG. 2, is mounted on the first portion 38 of pivotal arm assembly 22. Piston 60 is exposed for engagement with the moving wear plate 54 and has a portion which moves in sealing relationship with cylinder 58. Fluid is maintained under pressure from fluid lines 74 such that the piston 60 is in constant engagement with movable wear plate 54. Thus, as wear erodes a portion of the surface on wear plate 66, an adjustment is made by the fluid pressure on piston 60 moving the piston and the movable wear plate 54 against plate 66. This movable wear plate can be easily replaced to communicate a new surface to the discharge fluid of the material pump cylinder. Thus, when replaced the movable wear plate 54 operates to reduce wear on the duct 12 itself since the portion of the duct subjected to substantial abrasion is the inlet surface adjacent the outlet of the material pump cylinder 16.

For operating the system in the oscillatory motion as discussed above, there is provided a rear pivot actuating arm 64 which extends radially from the center pivot tube 18. As can be seen in FIG. 2, a piston-cylinder arrangement 62 is fixed to the rear pivot actuating arm 64 to oscillate the arm and ultimately the duct through the oscillatory movement and shift the distribution duct inlet between the outlets of the two material pump cylinders 16.

Figure 3A:
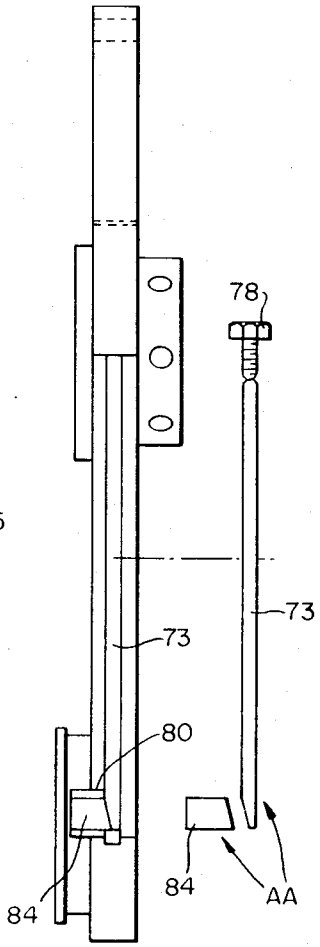
FIG. 3A is a side view of a pivot arm with an alternative adjusting mechanism.
Figure 3:
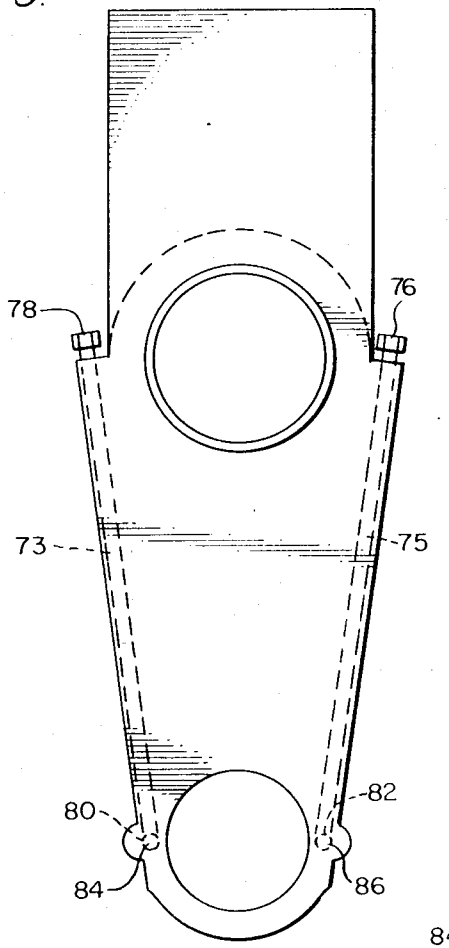
FIG. 3 is a front view of a pivot arm with an alternative adjusting mechanism.

In another embodiment of the invention as can be seen in FIG. 3, adjustment of the movable wear plate 54 is accomplished by a mechanical means which in some instances may prove more beneficial than the hydraulic or fluidic means described above. This mechanical means includes cam pistons 84 and 86 which move respectively in slots 80 and 82. The rear portion of these cam pistons 84 and 86 are engaged by corresponding cam surfaces at the end of rods 73 and 75 which move respectively in rod slots 74 and 72 as shown in FIG. 3.

Pistons 84 and 86 are positioned within lateral slots 85 and 87 respectively to engage a flange portion of the movable wear plate 54 on either side of the inlet to the distribution duct 12. Essentially pistons 84 and 86 are restrained from motion in any direction except longitudinally along the path defined by lateral slots 85 and 87 toward the movable wear plate 54. Interaction with the cam surfaces forces the pistons in the direction of the movable wear plate. As the surfaces acted on by the movable wear plate 54 become worn the change in dimensions can be compensated by adjusting nut 78 and 76 which force rods downwardly and cam the pistons 84 and 86 outwardly. The advantage of this system is that it is purely mechanical and eliminates the need to rely on fluidic assistance discussed above.

Figure 4:
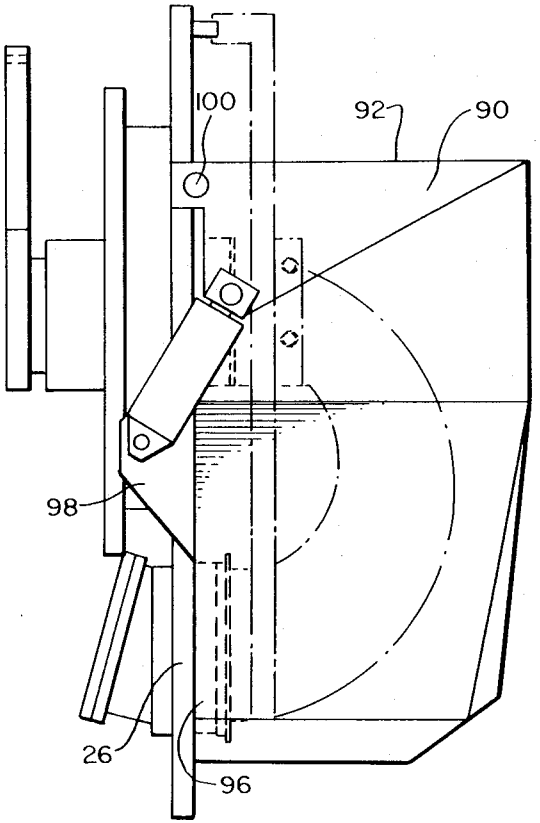
FIG. 4 is a side view of the apparatus with a hopper attached thereto.
Figure 5:
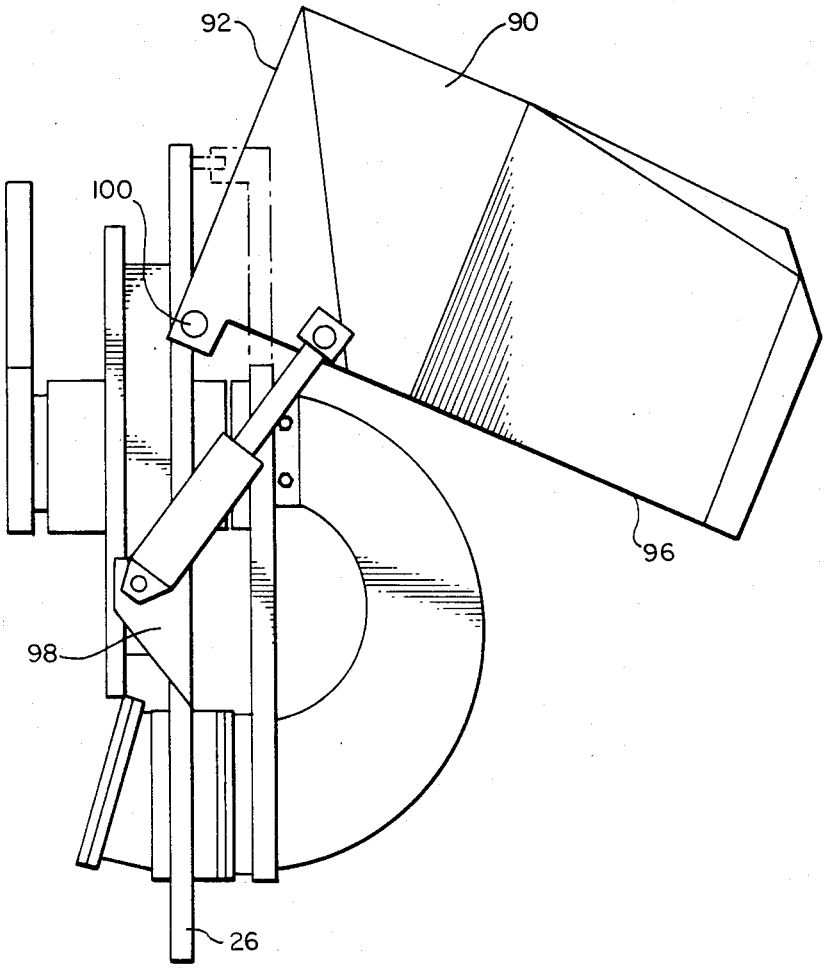
FIG. 5 is a side view of the apparatus with a hopper shown in an open position.

As can be seen in FIGS. 4 and 5 a movable hopper is provided to envelop the front portion of the apparatus for delivery of the material to be pumped. As shown in FIG. 4 the hopper 90 includes a front face 96 which in the closed position is coextensive with front pivot housing 26. In this manner the hopper can be sealed against at least the lower portion of the front pivot housing 26 while the hopper remains open at 92 for receiving the goods or materials to be pumped. When the hopper is used in this manner the material to be pumped is delivered through the top 92 of the hopper when it is in the closed position as shown in FIG. 4, in operation during a return stroke material is drawn into an exposed outlet for hydraulic cylinder. When the oscillating duct is moved to communicate with the outlet of cylinder having been just charged, during the power stroke the material charged into the cylinder is driven out of the cylinder through the duct into the discharge while the adjacent cylinder is drawing material therein for a subsequent power stroke and delivery.

The hopper is pinned for pivotal movement at 100 with the front pivot housing 26. A bracket 98 fixed on the lower portion of housing 26 also pivotally carries a piston-cylinder arrangement 94 which is also pinned to the hopper. As can be seen in FIG. 5 when piston-cylinder arrangement 94 is actuated the hopper is moved into a raised position which disengages the surface 96 from the front pivot housing 26. This exposes the entire internal portion of the hopper for cleaning purposes.

An advantage of this hopper and pump system is that it is compact and provides an easy method for cleaning the hopper. Systems in the past have not been able to accomplish this, because they have either required some sort of rigid structure in the vicinity of the oscillating duct to receive some of the thrust loads or the downstream portion of the pipe is located in such a position that the hopper simply cannot be located and operated in the manner discussed above.

The above has been a detailed discussion of the preferred embodiment. The full scope of applicant's invention is defined in the claims hereafter including all reasonable equivalents.

We claim:

1. A pipe apparatus for discharging material from a pump having a first pump outlet and a second pump outlet arranged substantially coplanar with each other comprising:

(a) a discharge pipe having an inlet for receiving material from the pump;

(b) a distribution duct having an end connected to said discharge pipe for pivotal movement therewith and a free end for communication alternately with said first and second pump outlets;

(c) a pivot arm secured for rotation about said discharge pipe and fixed to said distribution duct;

(d) means for pivoting said arm about said discharge pipe;

(e) a pivot housing fixed with respect to said arm;

(f) a thrust wear member connected to said arm and extending radially with respect to said discharge pipe for engaging said pivot housing to control forces on said pivot arm; and (g) said wear member cooperating with said pivot housing to offset torque forces imposed by material being pumped through said distribution duct.

2. The apparatus according to claim 1 further comprising a center pivot member at least partially circumscribing said discharge pipe for pivotal movement thereabout, said pivot arm being fixed to said center pivot member, said thrust member being fixed to said center pivot member and spaced axially from said arm.

3. The apparatus according to claim 2 wherein said center pivot member includes a thrust tube circumscribing said discharge pipe.

4. The apparatus according to claim 3 wherein said housing includes a bearing portion substantially concentric with said thrust tube and a radial portion for engaging said thrust member extending radially from said tube.

5. The apparatus according to claim 4 wherein said bearing portion of said housing is a cylindrical configuration substantially circumscribing said thrust tube.

6. The apparatus according to claim 5 wherein said radial portion of said housing includes two annular plates extending radially from said bearing portion, and spaced axially from one another for receiving therebetween said thrust member extending radially from said thrust tube.

7. The apparatus according to claim 6 further comprising bushing means located between said thrust tube and said cylindrical housing portion.

8. The apparatus according to claim 7 further comprising a rigid structure fixed relative to said center pivot member, said pivot arm having means for engaging said rigid structure to counteract forces imposed on said distribution duct.

9. The apparatus according to claim 8 wherein said pivot arm includes two portions, a first portion fixed to said distribution duct and a second portion for engaging said rigid structure.

10. The apparatus according to claim 9 wherein said rigid structure is located downstream of said discharge pipe inlet, said second portion of said pivot arm including rolling means for engaging said rigid structure.

11. The apparatus according to claim 10 further comprising a first adjusting means for moving said rolling means toward and away from said rigid structure.

12. The apparatus according to claim 11 where said first adjusting means includes a fluid actuated piston-cylinder arrangement.

13. The apparatus according to claim 12 wherein said pump outlets are circumscribed by a fixed telescoping wear plate, said free end of said discharge pipe connected to a movable wear plate for movement toward and away from said fixed telescoping wear plate, and further comprising means for moving said movable wear plate.

14. The apparatus according to claim 13 wherein said means for moving said movable wear plate includes a second piston-cylinder arrangement fixed to said pivotal arm.

15. The apparatus according to claim 14 wherein said first and second piston-cylinder arrangements are connected to a common source.

16. The apparatus according to claim 15 wherein said thrust member is a radial plate fixed to said thrust tube, said annular plates of said housing including a front annular plate and a rear annular plate, front and rear wear plates being spaced from one another in contiguous relationship respectively with said front and rear annular plates, for receiving said thrust plate therebetween.

17. The apparatus according to claim 16 wherein said rigid structure is fixed to said front annular plate of said housing.

18. The apparatus according to claim 17 wherein said first portion and said second portion of said pivot arm extend substantially in opposite directions.

19. The apparatus according to claim 18 further comprising an actuating arm fixed to said pivot tube for engagement by an actuating means for driving said arm to oscillate said distribution duct and said discharge pipe.

20. The apparatus according to claim 19 wherein said actuating means includes a piston-cylinder arrangement for oscillating said pivot tube.

21. The apparatus according to claim 20 further comprising a hopper for holding material in communication with said pump outlets, said hopper substantially enclosing said distribution duct, said pump outlets, and said discharge pipe inlet, and said hopper further defining an opening for receiving material from a dispensing means.

22. The apparatus according to claim 21 wherein said hopper is movable between a closed position and an open position, wherein said open position the internal portion of the hopper is exposed for cleaning through access other than said opening for receiving dispensed material.

23. The apparatus according to claim 22 further comprising hopper moving means for moving said hopper between said open and closed positions.

24. The apparatus according to claim 23 where in the closed position one wall of the hopper is formed at least in part by a portion of said front pivot housing.

25. The apparatus according to claim 11 where said first adjusting means includes mechanical adjusting means.

26. A pipe apparatus for discharging material from a pump having a first pump outlet and a second pump outlet arranged substantially coplanar with each other comprising:

(a) a discharge pipe having an inlet for receiving material from the pump;

(b) a distribution duct having an end connected to said discharge pipe for pivotal movement therewith and a free end for communication alternately with said first and second pump outlets;

(c) a pivot arm secured for rotation about said discharge pipe and fixed to said distribution duct;

(d) means for pivoting said arm about said discharge pipe;

(e) a pivot housing fixed with respect to said arm;

(f) a thrust wear member connected to said arm and extending radially with respect to said discharge pipe for engaging said pivot housing to control forces on said pivot arm;

(g) said pipe apparatus including a hopper substantially circumscribing the distribution duct and said housing being located substantially independently of said hopper for offsetting torque forces; and (h) said wear member cooperating with said pivot housing to offset torque forces imposed by material being pumped through said distribution duct independently of said hopper.

* * * * *